US008966678B2

(12) United States Patent
Jessen

(10) Patent No.: US 8,966,678 B2
(45) Date of Patent: Mar. 3, 2015

(54) LIFT APPARATUS

(71) Applicant: Mogens Jessen, Richmond (CA)

(72) Inventor: Mogens Jessen, Richmond (CA)

( * ) Notice: Subject to any disclaimer, the term of this patent is extended or adjusted under 35 U.S.C. 154(b) by 165 days.

(21) Appl. No.: 13/715,891

(22) Filed: Dec. 14, 2012

(65) Prior Publication Data

US 2014/0165287 A1 Jun. 19, 2014

(51) Int. Cl.
*A61G 7/10* (2006.01)

(52) U.S. Cl.
CPC ..... *A61G 7/1046* (2013.01); *A61G 7/1019* (2013.01); *A61G 7/1067* (2013.01); *A61G 7/1076* (2013.01); *A61G 7/1088* (2013.01); *A61G 7/1098* (2013.01); *A61G 2203/12* (2013.01); *A61G 2200/10* (2013.01)
USPC ..... 5/83.1; 5/86.1; 5/85.1; 5/87.1; 5/81.1 R

(58) Field of Classification Search
CPC ..... A61G 7/1046; A61G 2200/32; A61G 7/1015; A61G 7/1019; A61G 2200/34
USPC ..... 5/86.1, 81.1 R, 83.1, 85.1, 87.1, 88.1, 5/81.1 RP; 182/63.1, 64.1; 280/765.1
See application file for complete search history.

(56) References Cited

U.S. PATENT DOCUMENTS

| | | | | | |
|---|---|---|---|---|---|
| 795,524 | A | * | 7/1905 | Leffmann | 5/89.1 |
| 2,666,212 | A | * | 1/1954 | Flanders | 5/86.1 |
| 2,681,455 | A | * | 6/1954 | Schwartz | 5/86.1 |
| 3,394,933 | A | * | 7/1968 | Benoit | 482/67 |
| 3,629,880 | A | * | 12/1971 | van Rhyn | 5/83.1 |
| 3,790,974 | A | * | 2/1974 | Johansson | 5/83.1 |
| 3,931,956 | A | * | 1/1976 | Hawkins | 254/8 B |
| 3,940,808 | A | | 3/1976 | Petrini | |
| 3,988,790 | A | * | 11/1976 | Mracek et al. | 5/83.1 |
| 4,704,749 | A | * | 11/1987 | Aubert | 5/87.1 |
| 4,934,003 | A | * | 6/1990 | Hayakawa et al. | 5/81.1 RP |
| 4,999,862 | A | * | 3/1991 | Hefty | 5/87.1 |
| 5,201,377 | A | * | 4/1993 | Wilson | 180/6.5 |
| 5,390,380 | A | * | 2/1995 | James-Wallace | 5/84.1 |

(Continued)

FOREIGN PATENT DOCUMENTS

| | | | |
|---|---|---|---|
| NL | 1001881 | C2 | 6/1997 |
| WO | 2006032108 | A2 | 3/2006 |

OTHER PUBLICATIONS

Haycompvid, Eagle Lifter, <http://www.youtube.com/watch?v=uTPItEfxSeE>, Mar. 26, 2011.

(Continued)

*Primary Examiner* — Robert G Santos
*Assistant Examiner* — Myles Throop
(74) *Attorney, Agent, or Firm* — Oyen Wiggs Green & Mutala LLP

(57) ABSTRACT

A lift apparatus used for lifting and moving a person or object. The apparatus has a frame, wheels, a lift mechanism, a lift rod, an overhead support arm movable to a laterally extended position on a selected side of the apparatus, a rotatable head, a collar that is vertically movable along the head, an outrigger support with a bar pivotably affixed to the base frame and rotatable to the selected side of the apparatus, and an locking mechanism for retaining the bar on the side of the apparatus. A hanger on the overhead arm supports a load. A control system controls the lift mechanism. When the bar extends onto the selected side of the apparatus and the collar is in a predetermined vertical position along the head, the control system activates the lift mechanism and the overhead support arm is rotatable only to the selected side of the lift apparatus.

20 Claims, 9 Drawing Sheets

(56) References Cited

U.S. PATENT DOCUMENTS

| | | | | |
|---|---|---|---|---|
| 6,173,810 | B1 * | 1/2001 | Citron et al. | 182/18 |
| 6,260,218 | B1 * | 7/2001 | Tsuga | 5/86.1 |
| 7,331,607 | B1 * | 2/2008 | Schneider | 280/766.1 |
| 7,828,116 | B2 * | 11/2010 | Vetesnik | 182/18 |
| 7,996,934 | B2 | 8/2011 | Hay | |
| 8,584,273 | B1 * | 11/2013 | Simoes et al. | 5/83.1 |
| 8,696,025 | B2 * | 4/2014 | Forini et al. | 280/764.1 |
| 2003/0208844 | A1 * | 11/2003 | Moffa et al. | 5/86.1 |
| 2007/0059141 | A1 | 3/2007 | Raun | |

OTHER PUBLICATIONS

Sushim Koshti, Designing a Passenger Lift and Transfer Device Using 3D Modeling and Kinematic Simulation Techniques, Masters of Science Thesis, Sep. 17, 2007, Oregon State University, Oregon, USA.

UB-LET, ErgoPort, <http://www.ub-let.dk/index.php?page=ergoport>, 2012.

Haycomp Website Screenshot, <http://www.haycomp.com.au/>, accessed Oct. 23, 2014.

* cited by examiner

LIFT APPARATUS

1. TECHNICAL FIELD

The present invention generally relates to an apparatus for lifting and moving a person or item from one position to another, and more particularly, for lifting, transporting, and transferring a person from a wheelchair to a seat, such as in a vehicle.

2. BACKGROUND OF THE INVENTION

A person who depends on a wheelchair may face challenges when traveling and need assistance when moving from a wheelchair to a passenger seat in an aircraft, train or other vehicle. For example, in order to move from a wheelchair to a passenger seat in an aircraft, before boarding the aircraft, this person must first move from the wheelchair to a specially designed wheelchair that fits within the narrow aisle an aircraft. This transfer typically occurs in a waiting room, a departure lounge, a concourse, or on an aerobridge of an airport. After this person is moved into the specially designed wheelchair, he or she is transported onto the aircraft and into a passenger seat on the aircraft. This process requires two transfers. The first transfer is from the wheelchair to a specially designed wheelchair that fits within the aircraft's aisle. The second transfer is from the specially designed wheelchair to the passenger's seat. This multi-step transfer process often requires close physical contact with the passenger's thighs, knees and underarms, which may be an unpleasant and awkward experience for both the passenger and the person assisting the passenger, such as an airline employee. This process may also be physically onerous and injurious to the passenger being lifted or the person assisting the passenger, due to size or strength disparities between the two people. For example, an airline employee who repeatedly lifts heavy passengers from wheelchairs and into airline seats without mechanical assistance may risk injury.

According to one aspect, the present invention provides a lift apparatus for lifting and transferring a person from a wheelchair to a passenger seat in an aircraft efficiently, quickly, easily, and inexpensively. The apparatus allows a person assisting the passenger to lift the passenger into a passenger's seat on an aircraft while minimizing the extent of physical contact between these people.

3. SUMMARY OF THE INVENTION

On embodiment of the present invention is directed to an apparatus and a method for lifting, transporting, and transferring a person from a wheelchair to a seat in an aircraft. The present invention also facilitates lifting and transporting passengers of a wide range of sizes and weights, regardless of the passenger's size.

In one such embodiment, the apparatus of the present invention may be used to lift, transport, and transfer a person from a wheelchair to a seat in an aircraft quickly, easily, efficiently, and inexpensively.

In one such embodiment, the apparatus comprises a base frame, a lift mechanism, an overhead support arm member, an outrigger support, a hanger, and a control system.

The base frame may include base frame members, and a plurality of wheels.

The lift mechanism may include a cylindrical guide housing fixedly attached to the base frame, a lift rod telescopingly housed within the cylindrical guide housing for controlling the lift apparatus's position, a selector collar that is movable along the rotatable head into a predetermined vertical position, and a lift actuator.

The overhead support arm member is affixed to the lift rod and pivotably movable to a predetermined laterally extended position on a selected side of the lift apparatus, such as the right or left side of the apparatus.

The outrigger support comprises a laterally rotatable outrigger bar pivotably affixed to the base frame and rotatable to the selected side of the lift apparatus, and an outrigger locking mechanism for maintaining the laterally rotatable outrigger bar in a predetermined laterally extended position on the selected side of the lift apparatus.

The hanger is also slidably supported on the overhead support arm member and adapted to support a load, such as a person or heavy object.

When the outrigger locking mechanism locks the laterally rotatable outrigger bar into the predetermined laterally extended position on the selected side of the lift apparatus and when the selector collar is in the predetermined vertical position along the rotatable head, the control system activates the lift mechanism and the overhead support arm member is limited to be rotatable only to the selected side of the lift apparatus, which is the same side of the apparatus to which the outrigger support bar extends.

In another embodiment, the method of using the lift apparatus of the present invention includes rotating the laterally rotatable outrigger bar to a selected side of the apparatus in order to activate at least one outrigger position sensor switch associated with the selected side of the apparatus, locking the laterally rotatable outrigger bar into the predetermined laterally extended position on the selected side of the lift apparatus, moving the selector collar into the predetermined vertical position along the rotatable head that is associated with the selected side of the lift apparatus, activating the lift mechanism, elevating the overhead support arm member, and rotating the overhead support arm member to the same selected side of the lift apparatus. In yet a further embodiment, a lift apparatus is provided, comprising:

a base frame;

a lift mechanism attached to said base frame and comprising: a lift member and a lift actuator;

a rotatable support arm connected to said lift member wherein said lift member is operable to control a vertical position of said rotatable support arm, and wherein said support arm is movable to a laterally extended position on a selected side of said lift apparatus;

a support arm selector movable to a position corresponding to said selected side and to maintain said support arm on said selected side;

an outrigger support comprising: a laterally movable outrigger affixed to said base frame and movable to said selected side of said lift apparatus; an outrigger locking mechanism for retaining said outrigger in an extended position on said selected side of said lift apparatus; and a control system for controlling said lift mechanism, wherein when said outrigger is retained in said laterally extended position on said selected side of said lift apparatus and when said support arm selector is in said position corresponding to said selected side, said control system activates said lift mechanism and said support arm is limited to be movable to said selected side of said lift apparatus.

While aspects of the following description relate to operation of the apparatus in transferring a person from a wheelchair to a seat in an aircraft, the invention is not to be limited to this use.

Further advantages of the invention will become apparent when considering the drawings in conjunction with the detailed description.

4. BRIEF DESCRIPTION OF THE DRAWINGS

The device and method of using the device according to several embodiments of the present invention will now be described with reference to the accompanying drawing figures, in which.

Like reference numerals refer to corresponding parts throughout the several views of the drawings.

5. DETAILED DESCRIPTION OF THE INVENTION

The lift apparatus 1 according to an embodiment of the present invention may be used to lift a person or an object from one position to another. In a particular embodiment, the lift apparatus 1 may be used to move a person between a wheelchair or other assistive device and a passenger seat on a vehicle such as an aircraft. The lift apparatus 1 may be vertically and horizontally adjustable to allow for movement in multiple directions, which permits the person or object being lifted to be moved between various positions. The lift apparatus 1 may be sized to fit within an aisle of a vehicle such as an aircraft. It may also be modular and foldable so that it may be stowed in relatively small space, such as within the vehicle such as an aircraft. The lift apparatus 1 may desirably include one or more safety features to stabilize it while it is in use. These safety features mitigate the risk of the lift apparatus 1 tipping over or otherwise losing stability when, for example, an airline employee uses it to lift a heavy person from a wheelchair in an airline terminal or to place the person into a passenger seat in an aircraft.

Figure 1:
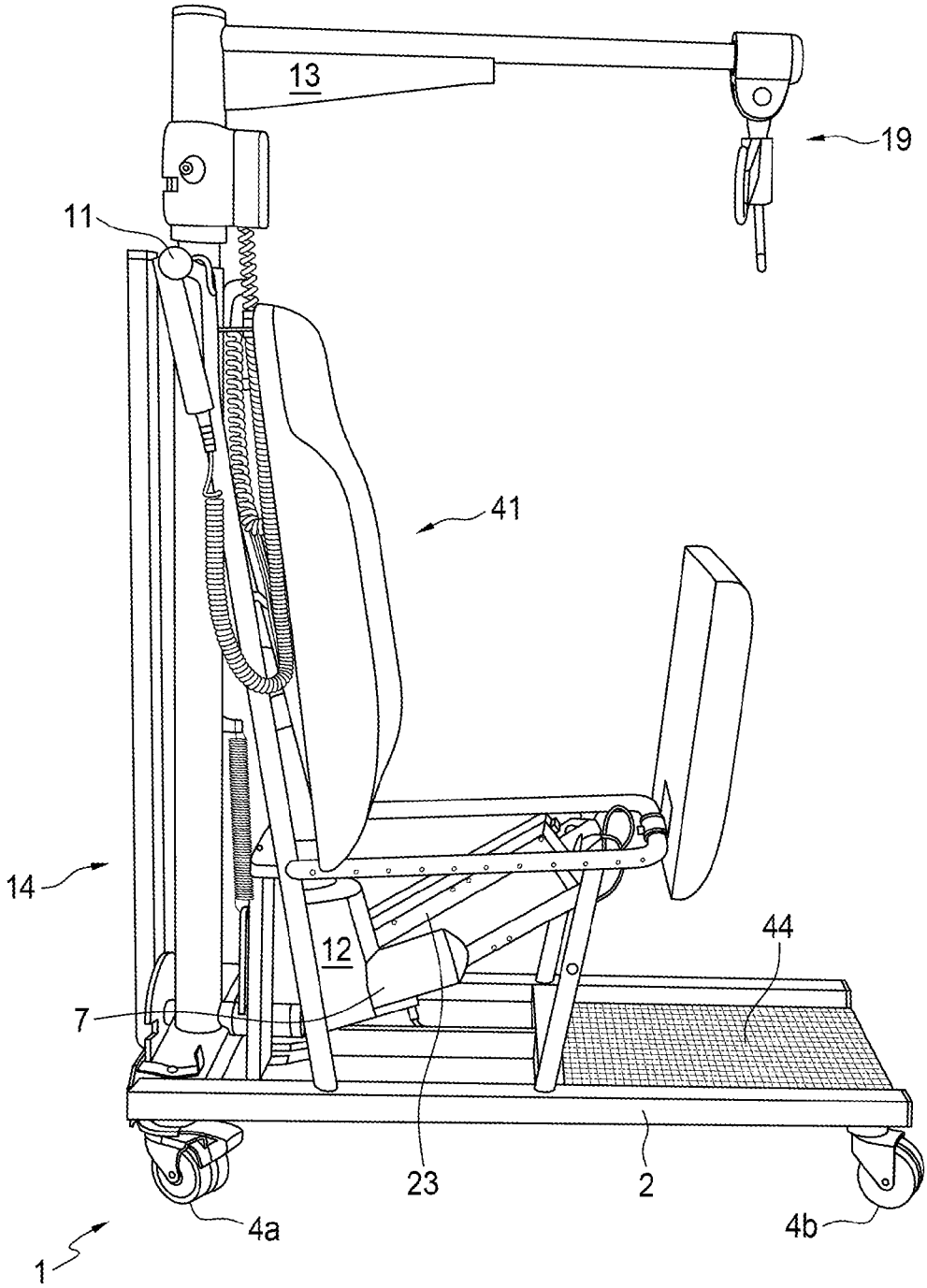
FIG. 1 illustrates a side view of the apparatus in accordance with an embodiment of the present invention.

FIG. 1 illustrates a side view of the apparatus 1 in accordance with an embodiment of the present invention, where the apparatus is shown in an inactive position. The lift apparatus 1 has a base frame 2, a rotatable support arm, such as an overhead support that includes an overhead support arm 6 and a rotatable head 20, a lift mechanism 7, an outrigger support 14, a lift actuator 12, and a control system (not shown). In another embodiment, the lift apparatus 1 may also additionally comprise a support hanger 19 such as may be slidably attached to the rotatable support arm, such as to overhead support arm 6, and a power source 23, such as to provide power for the lift actuator and/or the control system.

In one embodiment, the base frame 2 is supported such as by wheels 4*a*, 4*b* and 4*c*, 4*d* (not shown) which permits the lift apparatus 1 to be moved horizontally across a surface by rolling. The wheels 4*a*, 4*b* may be any type of wheels known in the art for vehicles used for transporting and lifting a person or heavy object, such as caster wheels. In an embodiment, the base frame may also have wheel locking mechanisms for preventing rotation of the wheels. The wheel locking mechanisms may be any suitable wheel locking mechanism known in the art for vehicles used for transporting and lifting a person or heavy object. In an embodiment, the wheels may have wheel frames and wheel frame locking mechanisms 5 for preventing the wheels from swiveling.

The lift 1 may also include a sling or other load supporting device (not shown) affixed to the hanger 19 to facilitate lifting a person who is immobile or semi-mobile. The lift apparatus 1 may also be used with any suitable seat 41 and/or footrest 44 known in the art when used to lift and transport a person. When using the apparatus 1 to lift and transport a person who is immobile, the seat 41 and footrest 44 may provide greater physical comfort to this person.

The base frame 2 and rotatable support arm components such as overhead support arm 6 and rotatable head 20 may be fabricated from any suitable materials, such as aluminum, stainless steel, iron, plastic, or other material with a suitable strength to weight ratio to support the weight of a person or heavy object. In one embodiment, the base frame 2 includes base frame members 3 and a plurality of wheels 4*a*-4*d* which are attached to the base frame 2. The base frame 2 may be formed as one uniform object or alternatively as a set of separate, discrete members connected to one another by any suitable connections or mechanical fasteners known in the art, such as welds or bolts, for example.

In one embodiment, the lift apparatus 1 may also have a handle bar 11 for facilitating transport of the apparatus across a surface and a bracket, such as support bracket 13 that connects the rotatable head 20 and the overhead support arm 6 to one another. The hanger 19 is supported by the overhead support arm 6. A sling (not shown) may be affixed to the hanger 19 to facilitate lifting and moving a person or heavy object into and out of the lift apparatus 1.

In an embodiment, a lift member, such as lift rod 9 may be telescopingly housed within a cylindrical guide housing 8 for controlling a vertical position of the overhead support arm 6 that is pivotably movable to a predetermined laterally extended position on a selected side of the lift apparatus, such as the left or right side of the apparatus. In such an embodiment, the overhead support arm 6 and the lift rod 9 may be rotatably connected to one another by any suitable mechanical connection known in the art, such as a bearing or bushing, for example.

Figure 2:
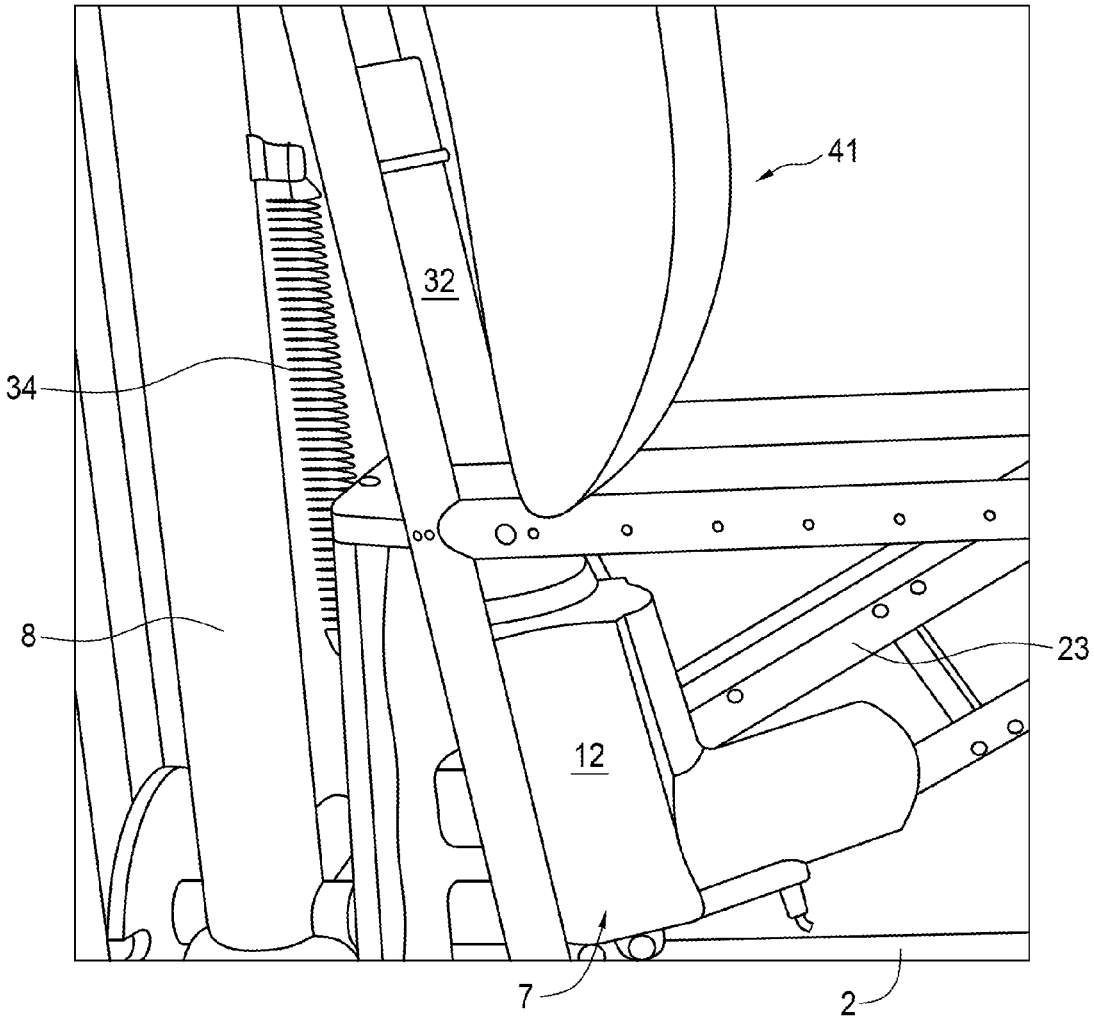
FIG. 2 illustrates a side, close-up view of the lift mechanism of the apparatus shown in FIG. 1 in accordance with an embodiment of the present invention.

FIG. 2 illustrates a side, close-up view of the lift mechanism 7 of the apparatus shown in FIG. 1 in accordance with an embodiment of the present invention. The lift mechanism 7 is fixedly attached to the base frame 2, such as by a cylindrical guide housing 8 fixedly attached to the base frame 2, and has a lift member, such as a lift rod (not shown) that is telescopingly housed within the cylindrical guide housing 8 for controlling the height and vertical position of the support arm, including overhead support bar 6, selector collar 10, and lift actuator 12. The lift member, such as lift rod 9 is used for controlling the position of the overhead support bar 6 as it is lifted. The lift mechanism 7 has a support arm selector, such as selector collar 10 that is movable with respect to the lift member and support arm, such as movable along the rotatable head 20 in a vertical direction between at least two discrete positions. In one embodiment, the lift actuator 12 may be a pneumatic or hydraulic actuator, a piston rod 31 and a cylinder 32, screw drive actuator, motor, or any other suitable lift actuator known in the art. FIGS. 1, 2, 4, 6 illustrate an embodiment of the present invention having a screw and nut type electrically powered lift actuator 12 with a lift rod 31 and a cylindrical housing 32.

Figure 3:
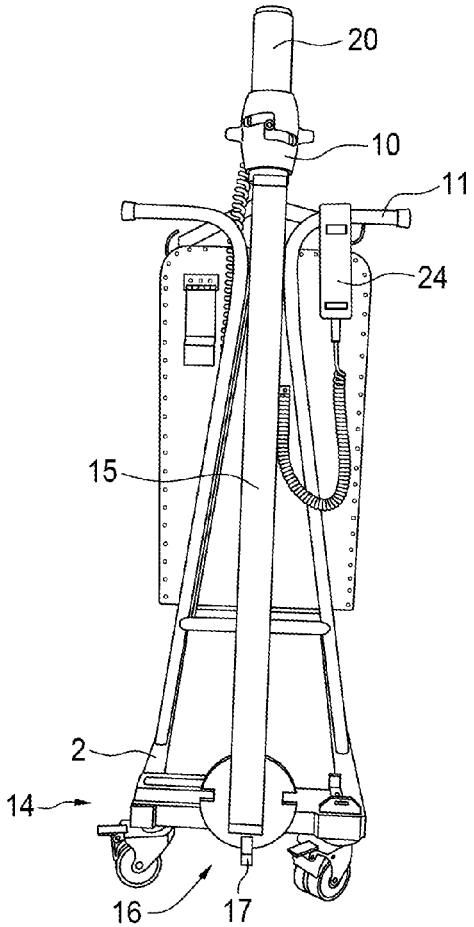
FIG. 3 illustrates a rear view of the apparatus shown in FIG. 1 in accordance with an embodiment of the present invention.
Figure 4:
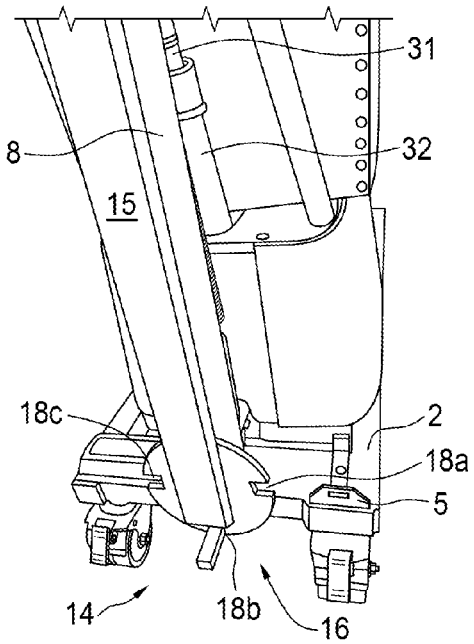
FIG. 4 illustrates a rear close-up perspective view of the outrigger bar of the apparatus shown in FIG. 1 with the outrigger bar in a stored, vertical position in accordance with an embodiment of the present invention.
Figure 5:
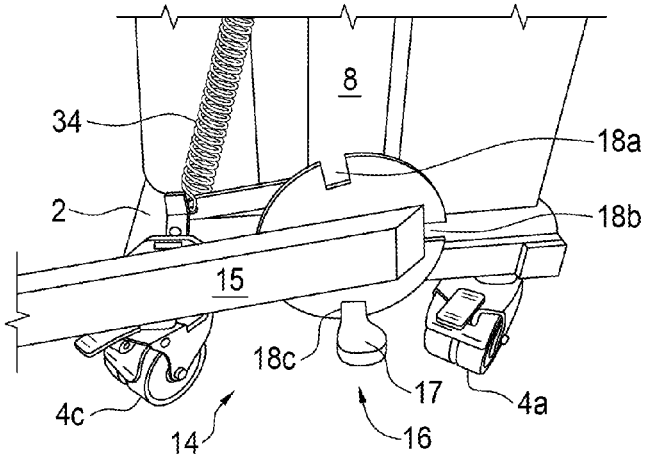
FIG. 5 illustrates a rear close-up perspective view of the outrigger bar of the apparatus shown in FIG. 1 with the outrigger bar in a rotated, laterally extended position in accordance with an embodiment of the present invention.

FIGS. 3-5 illustrate the outrigger support 14 on the lift apparatus 1 according to an embodiment of the invention. The outrigger support 14 stabilizes the lift apparatus 1 as it is used to lift a person or heavy object. The outrigger support 14 may have an outrigger, such as outrigger bar 15 that is pivotably affixed to the base frame 2 and rotatable to a selected side of the lift apparatus 1. The outrigger support 14 has a laterally rotatable outrigger bar 15 and an outrigger locking mechanism 16 for maintaining the bar 15 in a predetermined laterally extended position on the selected side of the lift apparatus 1, such as the left or right side of the apparatus 1. In an embodiment, the outrigger bar 15 may be rotatable to a position slightly above a surface, such as a floor, in order to facilitate moving the lift apparatus 1 across the surface after the outrigger bar 15 has been rotated to the selected side of the apparatus. The outrigger bar 15 and locking mechanism 16 may be fabricated from any suitable materials, such as aluminum, stainless steel, iron, plastic, or other suitable rigid material. In a particular embodiment, the outrigger locking mechanism 16 includes a spring-loaded release pedal 17 and at least one position indexing notch 18 disposed on the outrigger bar 15. The notch 18 is sized to accommodate the release pedal 17. The release pedal 17 may be spring loaded in order to maintain the pedal's position within the notch 18 and lock the outrigger bar 15 into a desired position. The outrigger locking mechanism 16 may be released by forcibly pushing the spring loaded release pedal 17 out of the notch 18*a*, 18*b*, 18*c*, which permits the outrigger bar 15 to pivot freely with respect to the release pedal 17. In an exemplary embodiment, the outrigger bar 15 has three notches 18*a*, 18*b*, 18*c* for securing the outrigger bar 15 into three desired positions, one stored vertical position and the two laterally extended positions.

FIGS. 3-4 show the outrigger bar 15 in a stored, vertical position with the release pedal 17 disposed in a notch 18*b* in order to lock the outrigger bar 15 into this stored position. FIG. 5 depicts the outrigger bar 15 in a rotated lateral position with the release pedal 17 disposed in a notch 18*c* in order to lock the outrigger bar 15 into this laterally extended position on left side of the apparatus.

The outrigger support 14 may be manually or automatically actuated and controlled. In a particular embodiment, the outrigger bar 15 is raised and lowered manually from the stored, vertical position as illustrated in FIGS. 3-4 to an extended lateral position by first depressing the release pedal 17, releasing the outrigger locking mechanism 16, and subsequently rotating the outrigger bar 15 into the lateral position on the selected side of the lift apparatus 1 as illustrated in FIG. 5. Once the outrigger bar 15 is in a laterally extended position on a selected side of the lift apparatus 1, the outrigger locking mechanism 16 locks the bar 15 into the laterally extended position through the pedal's engagement with the notch 18*a*, 18*c* on the outrigger bar 15. This secures the outrigger bar 15 into the laterally extended position and stabilizes the lift apparatus 1 while it is used to lift a person or object.

In an embodiment, the shape and length of the outrigger bar 15 may be fixed. In an alternate embodiment, the shape and length of the outrigger bar 15 may be modified to help stabilize the lift apparatus 1 and prevent it from tipping when it is used on an uneven surface. For example, the outrigger bar's length may be fixed or extendable using attachments in order to adjust its length and provide greater stabilization when the lift apparatus 1 is used to move a relatively heavy person or object. Also, spacers or attachments may be added to the end of the outrigger bar 15 in order to stabilize the apparatus when it is used on an uneven, stepped, or sloped surface.

Figure 6:
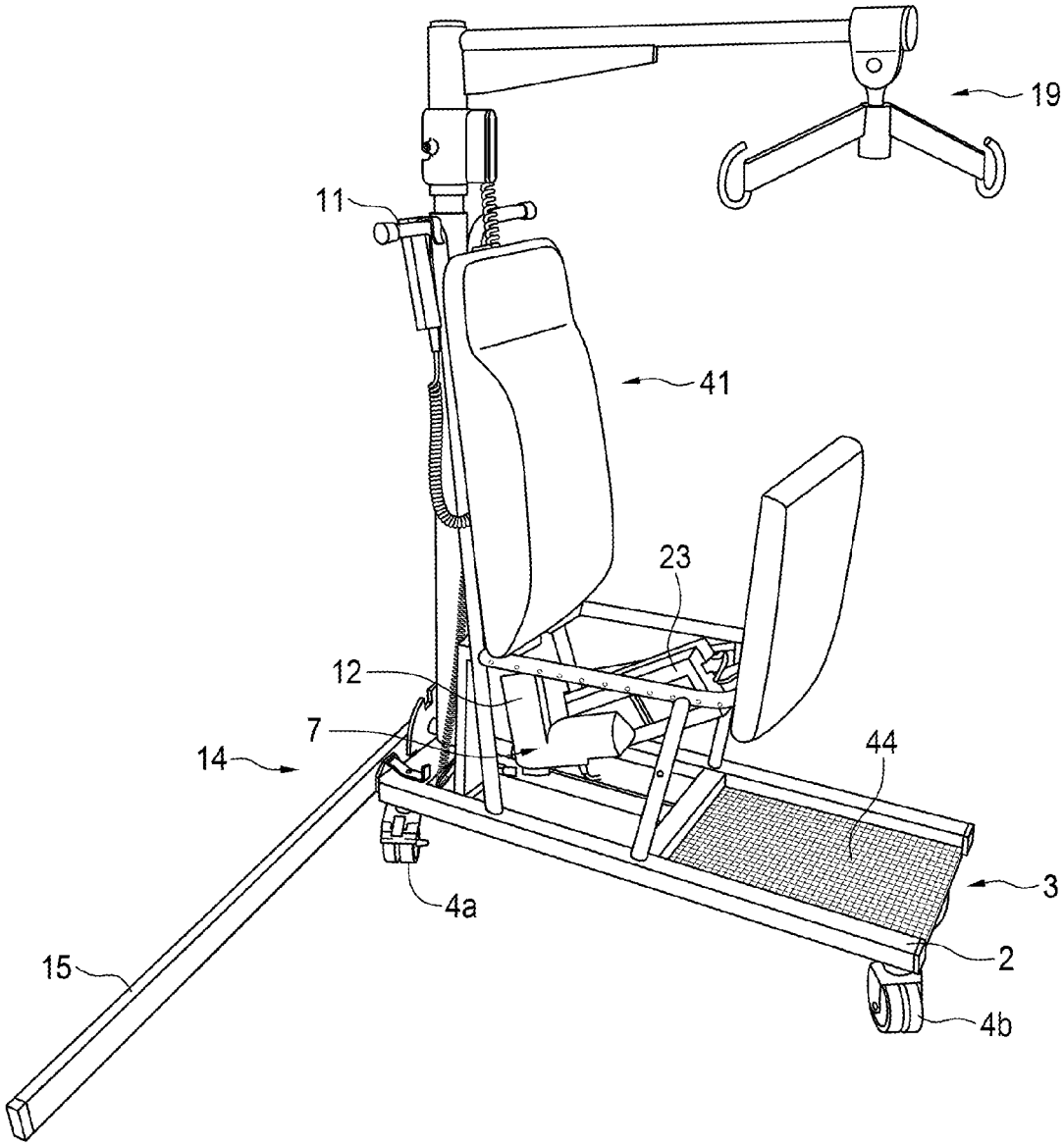
FIG. 6 illustrates a side perspective view of the apparatus shown in FIG. 1 with the outrigger bar in a rotated, laterally extended position in accordance with an embodiment of the present invention.

FIGS. 1 and 6 illustrate a load support hanger 19 supported on the overhead support arm member 6 of the lift apparatus 1 according to an embodiment of the invention. In a particular embodiment, the hanger 19 is used to support a load, such as person or a heavy object. The hanger 19 may be fixed into a desired position on the overhead support arm member 6. Alternatively, the hanger 19 may be slidable horizontally along the length of the overhead support arm member 6. In a particular embodiment, the hanger's position along the overhead support arm member 6 is manually adjustable. However, the hanger's position may also be adjusted automatically using any suitable control system known in the art. The hanger 19 may also include an attachment device, such as a hook, carabiner, or any other known device in the art for securing a person or object to the overhead support arm member 6. In a particular embodiment, the hanger 19 has a hook with a spring loaded locking mechanism for securing a sling to the overhead support arm member 6.

Figure 7:
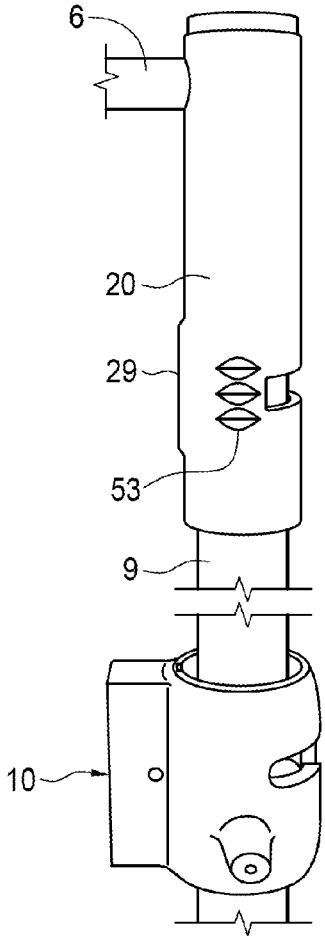
FIG. 7 illustrates an exploded view of a selector collar, an overhead support arm, indexing detents on the rotatable head, and a collar switch activation element for use with the apparatus shown in FIG. 1 in accordance with an embodiment of the present invention.
Figure 8:
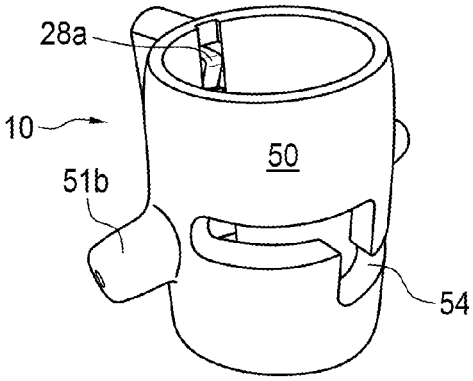
FIG. 8 illustrates a close-up perspective view of a selector collar for use with the apparatus shown in FIG. 1 in accordance with an embodiment of the present invention.
Figure 9:
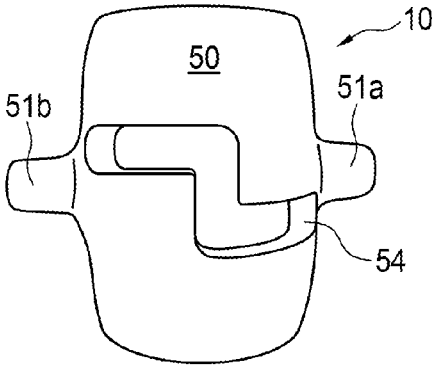
FIG. 9 illustrates a close-up front view of the selector collar shown in FIG. 8 in accordance with an embodiment of the present invention.

FIG. 7 illustrates an exploded view of the overhead support arm 6, selector collar 10, lift rod 9, rotatable head 20, indexing detents 53 disposed on the rotatable head 20, and selector collar switch activation element 29 for use with the apparatus shown in FIG. 1 in accordance with an embodiment of the present invention. These features are discussed further, below.

FIGS. 8-14 illustrate close-up views of an exemplary selector collar 10 for use as a support arm selector with the lift apparatus 1, according to an embodiment of the present invention. In an embodiment, the selector collar 10 has a hollow cylindrical body 50 that is sized to accommodate the lift rod 9 and rotatable head 20 through its body 50, a curved slot 54 formed in the cylindrical body 50, and a vertical selector collar locking mechanism (not shown) for securing the selector collar's vertical position along the rotatable head 20. In an embodiment, the curved slot 54 may formed partially within an inner wall (not shown) of the selector collar such that the slot is not visible on the collar's outer surface. In another embodiment, the curved slot 54 may be formed through the wall of the cylindrical body 50 and visible, as illustrated in FIGS. 7-17.

In a particular embodiment, the selector collar 10 has at least two lateral extensions 51*a*, 51*b* and the vertical selector collar locking mechanism may have a combination of spring-loaded pins 52 disposed within each lateral extension 51*a*, 51*b* and indexing detents 53 disposed on the rotatable head 20. The pins 52 engage with the indexing detents 53 to index vertical positions of the selector collar 10 along the rotatable head 20. In a particular embodiment, the indexing detents 53 are sized to accommodate the spring-loaded pins and prevent the selector collar 10 from slipping down the rotatable head 20. Also in a particular embodiment, there are two sets of indexing detents 53, one disposed on each side of the rotatable head 20 (not shown). Each set of indexing detents 53 contains three indexing detents 53 disposed in a vertical relationship with respect to one another along the rotatable head 20 and aligns with one of the spring loaded pins 52 disposed in the selector collar's lateral extensions 51*a*, 51*b*, respectively.

Figure 10:
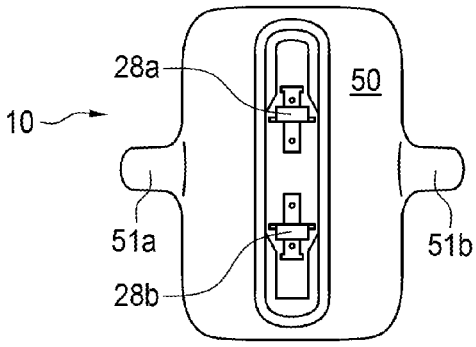
FIG. 10 illustrates a rear close-up view of the selector collar shown in FIG. 8 in accordance with an embodiment of the present invention.

FIG. 10 illustrates a rear close-up view of the selector collar 10 for use with the lift apparatus 1, according to one embodiment. In a particular embodiment, the selector collar 10 has two selector collar position sensor switches 28*a*, 28*b* disposed within it, which are positioned vertically with respect to one another along the rotatable head 20. The selector collar position sensor switches 28*a*, 28*b* interact with a collar switch activation element 29 affixed to the rotatable head 20. In a particular embodiment, when the selector collar 10 is in the uppermost position, the switch activation element 29 abuts and activates the lower selector collar position sensor switch 28*b* and when the selector collar 10 is in the lowermost position, the switch activation element 29 abuts and activates the upper selector collar position sensor switch 28*a*. The lift mechanism 7 may only be activated when one selector collar position sensor switch 28*a*, 28*b* is activated, corresponding to the selector collar being located in the lowermost or uppermost position, as discussed below.

Figure 11:
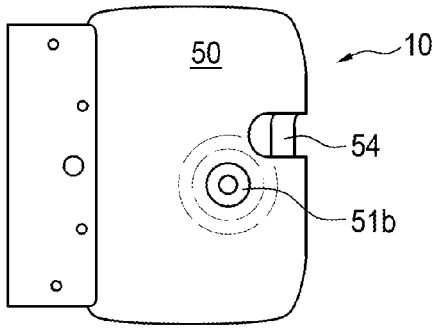
FIG. 11 illustrates a side close-up view of the selector collar shown in FIG. 8 in accordance with an embodiment of the present invention.
Figure 12:
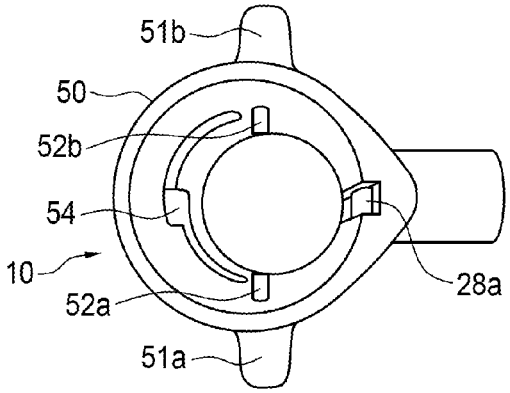
FIG. 12 illustrates a top close-up view of the selector collar shown in FIG. 8 in accordance with an embodiment of the present invention.

FIG. 11 illustrates a side close-up view of the selector collar 10 and the curved slot 54 and a lateral extension 51*b* formed within the hollow cylindrical body 50 of the selector collar 10 according to one embodiment. FIG. 12 illustrates a top close-up view of the selector collar 10, the curved slot 54 and the lateral extensions 51*a*, 51*b* formed within the hollow cylindrical body 50 of the selector collar 10 according to one embodiment. FIG. 12 also depicts the spring-loaded pins 52*a*, 52*b* extending from outwardly the lateral extensions 51*a*, 51*b* and toward the central axis of the hollow cylindrical body 50 and the at least one selector collar position sensor switch 28*a*, 28*b*.

Figure 13:
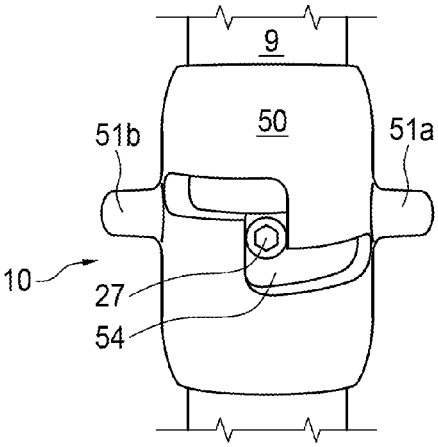
FIG. 13 illustrates a front close-up view of the selector collar shown in FIG. 8 moved into a predetermined neutral position on the rotatable head in accordance with an embodiment of the present invention.

FIG. 13 illustrates a front close-up view of the exemplary selector collar 10 of the apparatus shown in FIG. 1 in a predetermined neutral position along the rotatable head 20 in accordance with an embodiment of the present invention. In this neutral position, neither selector collar position sensor switch 28*a*, 28*b* abuts the switch activation element 29. In such an embodiment, an anchor bolt 27 fixed in lift rod 9 is located in the center of the curved slot 54. Neither selector collar position sensor switch 28*a*, 28*b* is activated when the selector collar 10 is in this neutral position. In such an embodiment, the collar switch activation element 29 also prevents the collar from rotating to the selected side of the apparatus 1 when the selector collar is in the neutral position.

Figure 14:
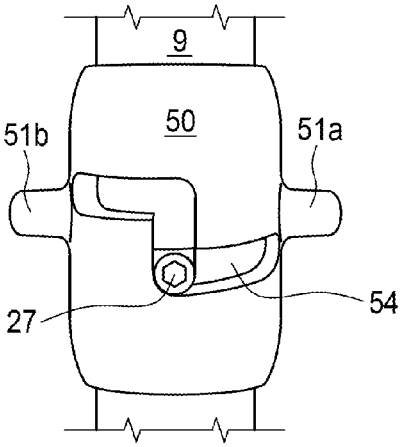
FIG. 14 illustrates a front close-up view of the selector collar shown in FIG. 8 moved into a predetermined uppermost position on the rotatable head in accordance with an embodiment of the present invention.

FIG. 14 illustrates a front close-up view of the exemplary selector collar 10 of the apparatus shown in FIG. 1 in a predetermined uppermost position along the rotatable head 20 in accordance with an embodiment of the present invention. When the selector collar 10 is in this predetermined uppermost position, the selector collar switch activation element 29 abuts and activates the lowermost selector collar position sensor switch 28*b* illustrated in FIG. 10, and the overhead support arm member 6 is rotatable to a predetermined laterally extended position on a selected side of the lift apparatus 1, corresponding to the uppermost collar position.

Figure 15:
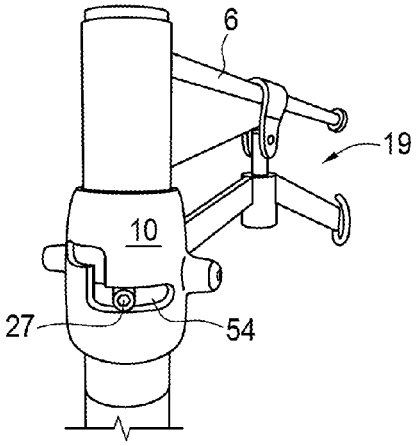
FIG. 15 illustrates a method of rotating the overhead support arm member to a selected side of the apparatus shown in FIG. 1 in accordance with an embodiment of the present invention.
Figure 16:
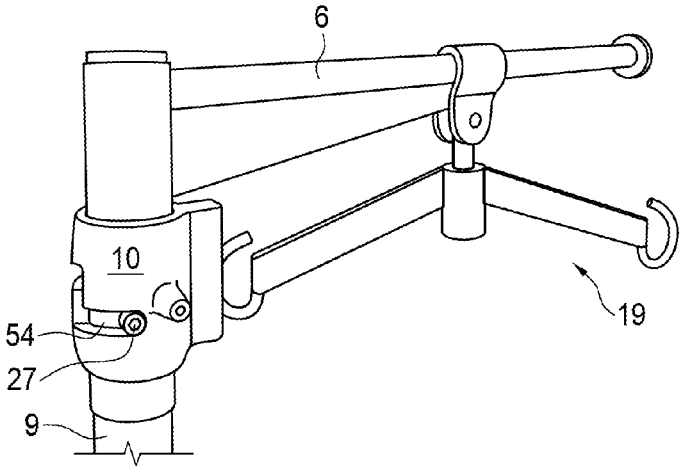
FIG. 16 illustrates a method of rotating the overhead support arm member fully rotated to a selected side of the apparatus shown in FIG. 1 in accordance with an embodiment of the present invention.
Figure 17:
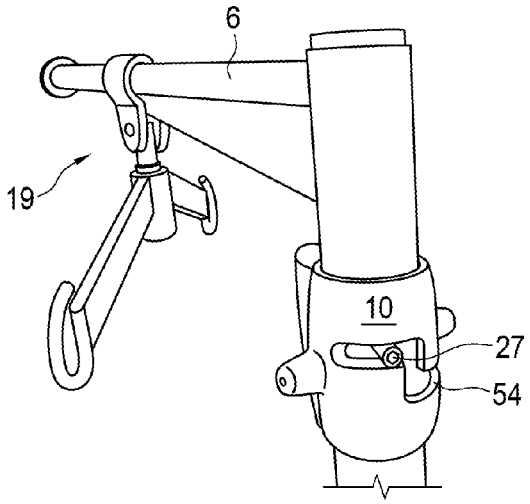
FIG. 17 illustrates a method of rotating the overhead support arm member rotated towards an opposite selected side of the apparatus from that shown in FIG. 16 in accordance with an embodiment of the present invention.

FIGS. 15-17 illustrate a method of rotating the overhead support arm member 6 to a selected side of the apparatus 1 shown in FIG. 1 in accordance with an embodiment of the present invention. FIGS. 15-16 illustrate how the overhead support arm member 6 may be moved to a selected side of the lift apparatus 1 when the selector collar 10 is moved to the uppermost position. FIG. 16 illustrates the anchor bolt 27 fixed in lift rod 9 and abutting the side of the curved slot 54 thereby preventing further rotation of the selector collar 10. In such an embodiment, the slot 54 shape and anchor bolt 27 limits the extent to which the overhead support arm 6 may be rotated to the selected side of the apparatus 1.

Alternatively, FIG. 17 illustrates how the overhead support arm member 6 is movable to the other selected side of the lift apparatus 1 when the selector collar 10 is moved to the lowermost position. In an optional embodiment, the overhead support arm member 6 may be detachably connected to the lift apparatus 1 in order to permit quick assembly and disassembly of the apparatus 1 and facilitate stowing the lift apparatus 1 in a small space, such as within an aircraft.

Figure 18:
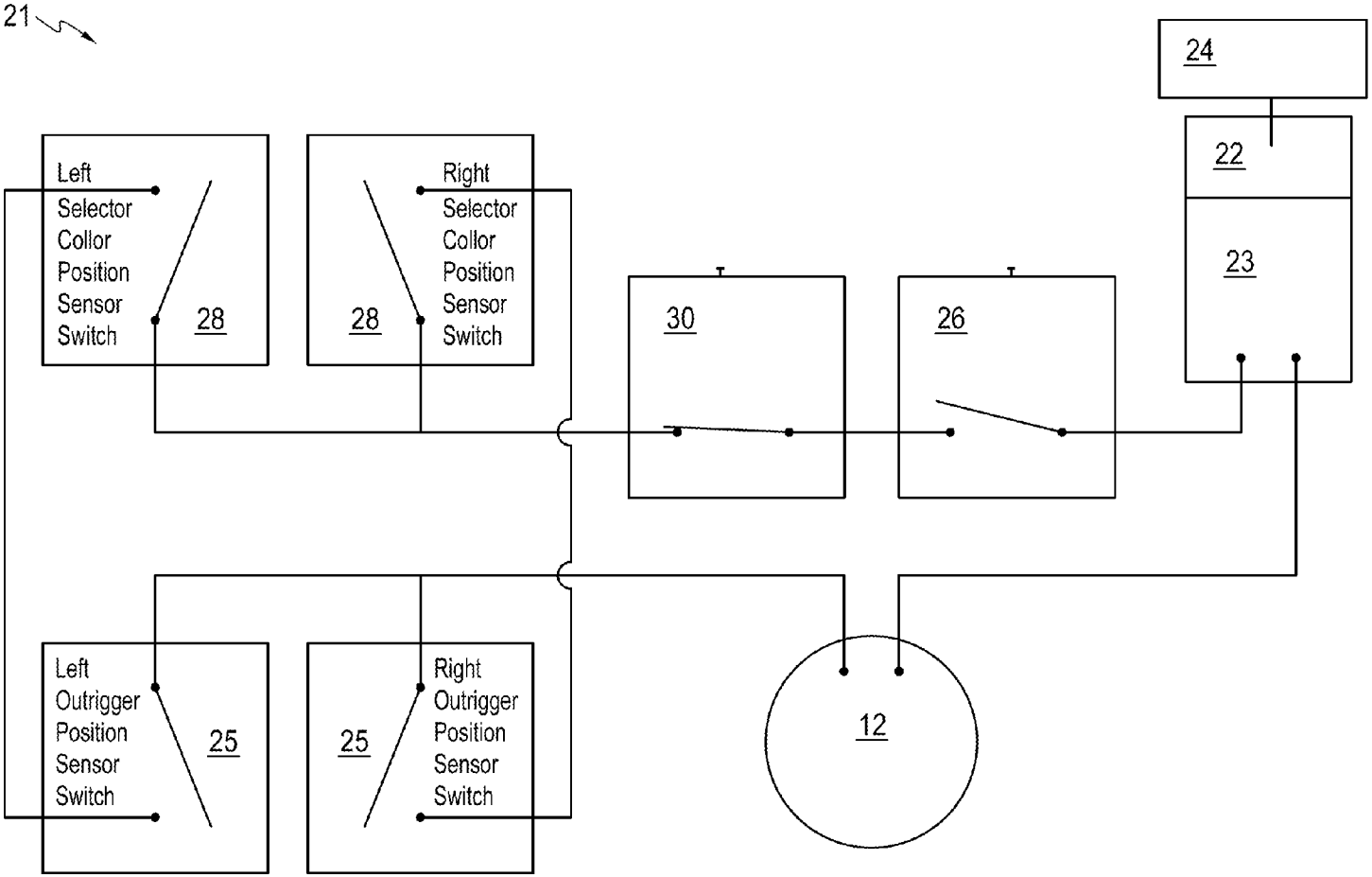
FIG. 18 illustrates a schematic of a control system for use with the apparatus shown in FIG. 1 in accordance with an embodiment of the present invention.
Figure 19:
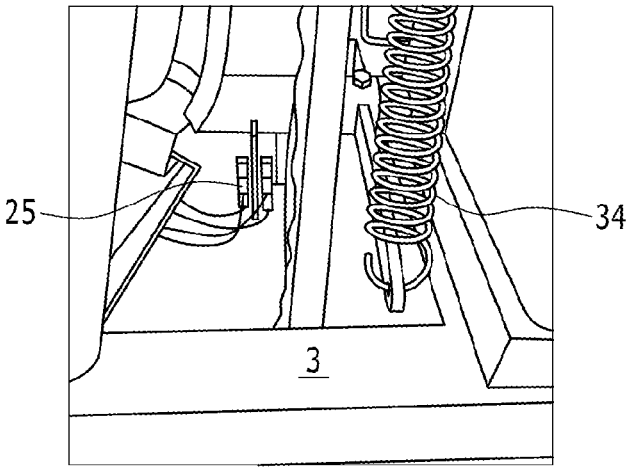
FIG. 19 illustrates a close-up view of the outrigger position sensor switch of the control system illustrates in FIG. 18 for use with the apparatus shown in FIG. 1 in accordance with an embodiment of the present invention.
Figure 20:
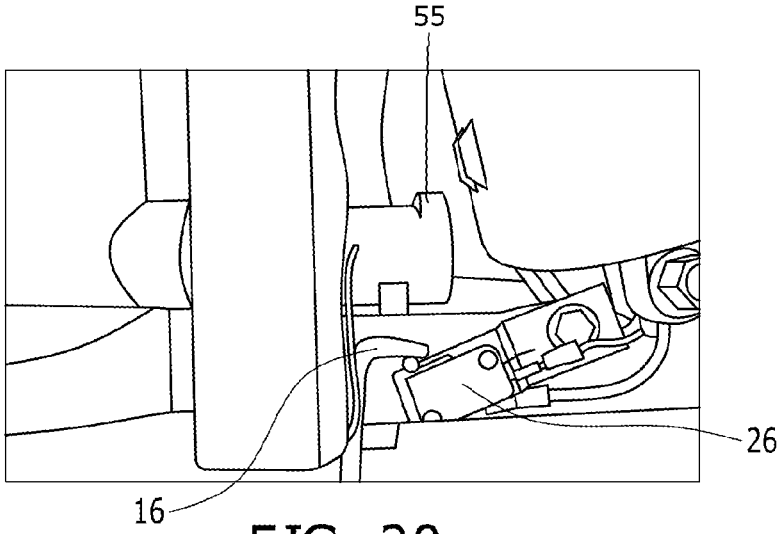
FIG. 20 illustrates a close-up view of the locking mechanism position sensor switch of the control system illustrated in FIG. 18 for use with the apparatus shown in FIG. 1 in accordance with an embodiment of the present invention, showing the locking mechanism in a locked position and the switch in a closed, activated state in accordance with an embodiment of the present invention.

FIGS. 18-20 illustrate a control system 21 for controlling the lift mechanism's movement according to an embodiment of the invention. FIG. 18 illustrates a schematic of an exemplary control system for use with an embodiment of the lift apparatus 1. The control system may be manually or automatically actuated using any suitable control system known in the art, such as an electric or electronic control system, for example. In a particular embodiment, the control system 21 has a power switch 22, a user controller 24, at least one outrigger position sensor switch 25, at least one locking mechanism position sensor switch 26, and at least one selector collar position sensor switch 28. The power switch 22 controls the power supplied to the lift mechanism 7. The power source 23 may be an electrical outlet, a battery, a combination of these items, or any other suitable power source known in the art. In a particular embodiment, the power source 23 may be a rechargeable battery. The user controller 24 may be a hand held remote control device that interacts with the control system 21 through a wire or any suitable wireless connection known in the art. The user controller 24 may have power and lift control buttons. The power button turns the control system 21 on and off by activating and deactivating the power switch 22. The lift control buttons control the vertical movement of the lift mechanism 7 when the control system is activated. The outrigger position sensor switch 25 and locking mechanism position sensor switch 26 communicate with the selector collar position sensor switch 28. In a particular embodiment, the control system 21 activates the lift mechanism 7 only when the laterally rotatable outrigger bar 15 is rotated to a laterally extended position on a selected side of the lift apparatus 1, the outrigger locking mechanism 16 locks the outrigger bar 15 into this laterally extended position, and the support arm selector, such as selector collar 10, is in a predetermined vertical position corresponding to the selected side of the lift apparatus along the rotatable head 20 of the support arm, as described below.

In a particular embodiment, the control system 21 is configured to activate the lift mechanism 7 only when a set of switches associated with either one or the other side of the apparatus is closed and activated.

The at least one outrigger position sensor switch 25 and at least one locking mechanism position sensor switch 26 are operationally connected to and communicate with the at least one selector collar position sensor switch 28. In a particular embodiment, the control system 21 has two sets of switches, each set corresponding to a selected side of the lift apparatus, such as the right or left side. In a particular embodiment, each set of switches has an outrigger position sensor switch 25, a locking mechanism position sensor switch 26 and a selector collar position sensor switch 28. For example, there may be one set of outrigger, locking mechanism, and selector collar position sensor switches associated with the right side of the apparatus 1 and another set associated with the left side of the apparatus 1. In a particular embodiment, the lift mechanism 7 is activated only when all of the switches in one set of switches associated with a particular side of the apparatus is closed and activated.

In a preferred embodiment, the outrigger position sensor switches are activated when the outrigger bar 15 is moved into a predetermined laterally extended position on a selected side of the lift apparatus 1. This activates the outrigger position sensor switch 25 associated with this selected side of the apparatus. When the outrigger locking mechanism 16 locks the outrigger bar 15 into this position, it activates the locking mechanism position sensor switch 26 also associated with this selected side of the apparatus 1.

For example, in a particular embodiment, the outrigger position sensor switch 25 and locking mechanism position sensor switch 26 associated with the right side of the apparatus are activated only when the outrigger bar 15 is rotated and locked into position on the right side of the lift apparatus 1. Conversely, the outrigger position sensor switch 25 and locking mechanism position sensor switch 26 associated with the left side of the apparatus are activated only when the outrigger bar 15 is rotated and locked into position on the left side of the lift apparatus 1.

Also, in a particular embodiment the selector collar position sensor switches 28 are activated only when the selector collar 10 is moved into a predetermined, uppermost or lowermost, vertical position on the rotatable head 20. In a particular embodiment, when the selector collar 10 is moved into the uppermost vertical position on the rotatable head 20, as illustrated in FIGS. 14-16, the selector collar position sensor switch **28*b* associated with the right side of the apparatus 1 is closed and activated and the overhead support arm member 6 is limited by the collar 10 to be rotatable only to the right side of the apparatus 1. Conversely, when the selector collar 10 is moved into the lowermost vertical position on the rotatable head 20, as shown in FIG. 17, the selector collar position sensor switch 28*a* associated with the left side of the apparatus is closed and activated and the overhead support arm member 6 is limited by the collar 10 to be rotatable only to the left side of the apparatus 1**.

In a particular embodiment, when the outrigger bar 15 is rotated to the right side of the apparatus and the selector collar 10 is moved into an uppermost position on the rotatable head 20, as illustrated in FIGS. 15-16, the switches associated with the right side of the apparatus are closed and activated. This permits the lift mechanism 7 to be actuated and the overhead support arm member 6 to be raised and lowered and to be rotated to the right side of the lift apparatus 1 only, as illustrated in FIGS. 15-16. Alternatively, when the outrigger bar 15 is rotated to the left side of the apparatus and the selector collar 10 is moved into an lowermost position on the rotatable head 20, as illustrated in FIG. 17, the switches associated the left side of the apparatus are closed and activated. This permits the lift mechanism 7 to be actuated and the overhead support arm member 6 to be raised and lowered and to be rotated to the left side of the lift apparatus 1 only, as illustrated in FIG. 17.

In one embodiment, the control system 21 and the selector collar 10 design may desirably prevent the lift mechanism 7 from being actuated when the outrigger bar 15 and overhead support arm member 6 are rotated to opposite sides of the lift apparatus 1 with respect to one another. For example, in a particular embodiment, when the outrigger bar 15 is rotated to the right side of the apparatus 1 and the selector collar 10 is moved into the lowermost indexed position along the rotatable head 20, which would permit the overhead member 6 of the support arm to be rotated to the opposite, or left side, of the apparatus 1, the control system 21 would not be able to activate the lift mechanism 7 because the outrigger position sensor switch 25 and selector collar position sensor switch 28 associated with the right side of the apparatus 1 would be closed and open, respectively. The control system 21 and mechanical design of the selector collar collectively prevent the life mechanism from being actuated unless the outrigger bar 15 is locked into a position on a selected side of the apparatus and the overhead support arm member 6 is rotatable only to that same selected side of the apparatus to which the outrigger bar 15 extends. These configurations and safety features may desirably prevent the lift mechanism 7 from being actuated unless both the outrigger bar 15 and the overhead support arm member 6 are configured to be rotated to the same side of the apparatus in order to mitigate the risk of the apparatus tipping or otherwise becoming unbalanced while in use.

FIG. 19 illustrates a close-up view of the outrigger position sensor switch 25 of the control system 21 of FIG. 18 according to an embodiment of the invention as well as a spring 34 connected to the outrigger support bar 15 and a base frame member 3.

FIG. 20 illustrates a close-up view of the locking mechanism position sensor switch 26 of the control system 21 of FIG. 18 according to an embodiment of the present invention. FIG. 20 illustrates the locking mechanism 16 in a locked position and the locking mechanism position sensor switch 26 in a closed, activated state. FIG. 20 further illustrates an outrigger position lobe 55 which is attached to the outrigger bar 15 and triggers the outrigger position sensor switch 25 shown in FIG. 19 depending on the position of the outrigger bar 15, according to a particular embodiment of the invention.

A method of using the lift apparatus 1 to move an immobile or semi-mobile person from a wheelchair or other assistive device, such as located in an airline terminal to a passenger seat on a vehicle such as an aircraft, and vice-versa, is described as follows in accordance with an embodiment of the present invention.

First, the lift apparatus is used to move the person from a wheelchair and into the apparatus 1. The lift apparatus 1 may be positioned immediately beside and as close as possible to the wheelchair, for example, such as immediately beside the right side of the wheelchair. The person operating the lift apparatus 1 such as an airline employee may then lock the one or more wheels 4*a*-4*d* into place in order to prevent the lift apparatus 1 from sliding horizontally during use. The operator then presses the release pedal 17, releases the outrigger locking mechanism 16, and rotates the outrigger support bar 15 from the stored, vertical position to a laterally extended position on the left side of the apparatus 1. Once the outrigger bar 15 is fully extended laterally the outrigger locking mechanism 16 locks the outrigger bar 15 into this left side laterally extended position.

A sling (not shown) is then placed around the person in the wheelchair. The apparatus operator then moves the selector collar 10 into a predetermined position on the rotatable head 20 corresponding to the left side of the lift apparatus 1, for example in the lowermost position, and rotates the overhead support arm member 6 to the left side of the apparatus. The lift apparatus 1 operator then presses the power button on the user controller 24 in order to turn on the lift mechanism 7. The lift operator then presses the lift control button in order to lower the overhead support arm member 6 down toward the person in the sling. The operator then connects the person to the lift apparatus 1 by attaching the sling to the hanger 19 on the overhead support arm member 6. Next, the operator presses the lift control button on the user controller 24 in order to raise the lift mechanism 7 and elevate the person in the sling. Next, the operator rotates the overhead support arm member 6 to a central position directly over the lift apparatus 1 such as directly over the seat 41 in a particular embodiment. Then, optionally, the operator presses the lift control button on the user controller 24 in order to lower the sling and the person onto the lift apparatus 1, and in a particular embodiment, onto the seat 41 in the lift apparatus 1. The operator may then optionally move the selector collar 10 to the centre neutral position along the rotatable head 20. The operator then returns the outrigger bar 15 from the laterally extended position to the stored vertical position by releasing the outrigger locking mechanism 16 (i.e. depressing the release pedal 17) and rotating the outrigger support bar 15 back into the stored, vertical position.

In a particular embodiment, the outrigger support bar 15 may be spring loaded using a spring 34 such that the outrigger support bar 15 rotates back into the stored, vertical position automatically when the operator presses the release pedal 17, which automatically releases the locking mechanism. Next, the operator unlocks the wheels. Next, the operator may optionally disengage the wheel frame locking mechanisms 5, such as if rotation of the lift apparatus 1 is required, and then pushes the lift apparatus 1 in order to transport the person. The optional wheel locking mechanisms may be any suitable wheel locking mechanisms known in the art, such as locking casters, for example, such as to prevent at least one of movement of the wheel around its horizontal axle, and/or swiveling or turning of the wheel around a vertical axis.

The lift apparatus 1 may optionally also be used with a portable ramp (not shown), which may be stowed below the apparatus 1 in order to facilitate transporting the apparatus 1 over an uneven or discontinuous surface on the airline terminal floor or for example, across a gap or angled surface between the aircraft entrance and the terminal or jetway floor.

Next, after the operator moves the lift apparatus 1 along the aisle in the vehicle such as an aircraft and prepares to unload the immobile person from the lift apparatus 1 and into the passenger's seat. First, the operator places the apparatus 1 immediately beside the immobile person's seat on the aircraft. Next, the operator may lock one or more of the wheels into place in order to stabilize the lift apparatus 1 and prevent it from sliding along the aisle in the aircraft. The operator then presses the release pedal 17, releases the outrigger locking mechanism 16, and rotates the outrigger support bar 15 from the stored, vertical position to a laterally extended position on the same side of the apparatus as the passenger's seat on the aircraft. In a particular embodiment, the locking mechanism may be spring-loaded such that by depressing the release pedal 17, the bar 15 automatically and independently rotates back into the stored, vertical position. Once the outrigger bar 15 is fully extended, the outrigger locking mechanism 16 locks the bar 15 into the laterally extended position. Next, the operator moves the selector collar 10 into the predetermined position on the rotatable head 20 that would permit the overhead support arm member 6 to be rotated to the same side of the apparatus where the passenger's seat is located and the operator presses the power button in order to activate the lift mechanism 7. The lift operator then presses the lift control button in order to lift the overhead support arm member 6. The operator next rotates the overhead support arm member 6 over the seat on the aircraft such that the person in the sling is suspended directly over the passenger's seat. The operator next presses the lift control button on the user controller 24 in order to lower the overhead support arm member 6 and gently lower the person into the seat. The operator then removes the sling from the person's limbs. The operator may also remove the sling from the hanger 19 at this time.

After the operator helps the immobile person into his or her airline seat, the operator may then stow the apparatus on the aircraft or transport it back to the terminal by rotating the overhead support arm member 6 back to a central position, pressing the lift control button to lower the overhead support arm member 6 and hanger 19, moving the selector collar 10 from the uppermost or lowermost position to a centered, neutral position and rotating the outrigger support bar 15 into the stored, vertical position, releasing the wheel locking mechanisms, and transporting the apparatus back to the airline terminal or stowing it in the aircraft for subsequent use at the passenger's destination.

According to a further embodiment, the lift apparatus 1 may have features that are modular, such as easily removable or re-fastenable structural components in order to facilitate quick disassembly and storage of the device, for example, into small spaces within an aircraft. For example, the overhead support arm member 6 may be optionally removable from the lift rod 9 and the hanger 19 may be optionally removable from the overhead support arm member 6.

According to a further embodiment, the control system may include an emergency override switch for immediately shutting off the control system and stopping all actuation and lifting, for example, in the event of an emergency.

According to a further embodiment, the lift apparatus 1 may be self-propelled using any self-propulsion unit known in the art. The present invention may also be used to lift, transport, and transfer a person from a wheelchair to a seat in a vehicle, chair, bed, toilet seat and/or shower chair and vice versa in, for example, a home, nursing home, or hospital environment.

As will be apparent to those skilled in the art in light of the disclosure, many alterations and modifications are possible in the practice of this invention without departing from the spirit or scope of it. Accordingly, the scope of the invention is to be construed in accordance with the substance defined by the following claims.

LIST OF FEATURES

1 lift apparatus
2 base frame
3 base frame members
4 plurality of wheels
5 wheel frame locking mechanisms
6 overhead support arm
7 lift mechanism
8 cylindrical guide housing
9 lift rod
10 selector collar
11 handle bar
12 lift actuator
13 support bracket
14 outrigger support
15 outrigger bar
16 outrigger locking mechanism
17 release pedal
18 indexing notch
19 hanger
20 rotatable head on overhead support
21 control system
22 power switch
23 power source (i.e. battery)
24 user controller
25 outrigger position sensor switch
26 locking mechanism position sensor switch
27 anchor bolt
28 selector collar position sensor switch
29 collar switch activation element
30 emergency stop switch
31 piston rod
32 cylindrical housing
34 spring
41 seat
44 footrest
50 cylindrical body of selector collar
51 lateral extensions
52 spring loaded pins
53 indexing detents
54 curved slot
55 outrigger position lobe

What is claimed is:

1. A lift apparatus comprising:
a base frame comprising
base frame members and
a plurality of wheels,
an overhead support comprising
an overhead support arm, and
a rotatable head,
a lift mechanism comprising
a cylindrical guide housing fixedly attached to the base frame,
a lift rod telescopingly housed within the cylindrical guide housing for controlling a position of the overhead support arm pivotably moveable to a predetermined laterally extended position on a selected side of the lift apparatus and rotatably connected to the lift rod,
a selector collar moveable along the rotatable head into a predetermined vertical position, and
a lift actuator,
an outrigger support comprising
a laterally rotatable outrigger pivotably affixed to the base frame and rotatable to the selected side of the lift apparatus, and
an outrigger locking mechanism for retaining the laterally rotatable outrigger in a predetermined laterally extended position on the selected side of the lift apparatus,
a hanger supported on the overhead support arm and adapted to support a load, and
a control system for controlling the lift mechanism,
wherein when the laterally rotatable outrigger is retained into the predetermined laterally extended position on the selected side of the lift apparatus and when the selector collar is in the predetermined vertical position along the rotatable head, the control system activates the lift mechanism and the overhead support arm can be rotated only to the selected side of the lift apparatus.

2. A method of using a lift apparatus comprising the steps of
providing a lift apparatus comprising:
a base frame comprising
base frame members and
a plurality of wheels,
an overhead support comprising
an overhead support arm, and
a rotatable head,
a lift mechanism comprising
a cylindrical guide housing fixedly attached to the base frame,
a lift rod telescopingly housed within the cylindrical guide housing for controlling a position of the overhead support arm pivotably moveable to a predetermined laterally extended position on a selected side of the lift apparatus and rotatably connected to the lift rod,
a selector collar moveable along the rotatable head into a predetermined vertical position, and
a lift actuator,
an outrigger support comprising
a laterally rotatable outrigger pivotably affixed to the base frame and rotatable to the selected side of the lift apparatus, and
an outrigger locking mechanism for retaining the laterally rotatable outrigger in a predetermined laterally extended position on the selected side of the lift apparatus,
a hanger supported on the overhead support arm and adapted to support a load, and
a control system for controlling the lift mechanism, the control system comprising
a power switch for activating the lift mechanism,
at least one outrigger position sensor switch, at least one locking mechanism position sensor switch, and at least one selector collar position sensor switch, wherein the at least one outrigger position sensor switch is operationally connected to the at least one selector collar position sensor switch, and wherein when the laterally rotatable outrigger is retained into the predetermined laterally extended position on the selected side of the lift apparatus and when the selector collar is in the predetermined vertical position along the rotatable head, the control system activates the lift mechanism and the overhead support arm can be rotated only to the selected side of the lift apparatus;

rotating the laterally rotatable outrigger to a selected side of the apparatus in order to activate the at least one outrigger position sensor switch;

retaining the laterally rotatable outrigger into the predetermined laterally extended position on the selected side of the lift apparatus;

moving the selector collar into the predetermined vertical position rotatable head that is associated with the selected side of the lift apparatus;

activating the lift mechanism;

elevating the overhead support arm; and rotating the overhead support arm to the selected side of the lift apparatus.

3. A lift apparatus comprising:

a base frame;

a lift mechanism attached to said base frame and comprising:

a lift member; and a lift actuator;

a rotatable support arm connected to said lift member wherein said lift member is operable to control a vertical position of said rotatable support arm, and wherein said support arm is moveable to a laterally extended position on a selected side of said lift apparatus;

a support arm selector moveable to a position corresponding to said selected side and to maintain said support arm on said selected side;

an outrigger support comprising:

a laterally moveable outrigger affixed to said base frame and moveable to said selected side of said lift apparatus; and an outrigger locking mechanism for retaining said outrigger in an extended position on said selected side of said lift apparatus; and a control system for controlling said lift mechanism, wherein when said outrigger is retained in said laterally extended position on said selected side of said lift apparatus and when said support arm selector is in said position corresponding to said selected side, said control system activates said lift mechanism and said support arm can be moved only to said selected side of said lift apparatus.

4. The lift apparatus of claim 3, wherein said support arm selector comprises a selector collar which further comprises:

a hollow substantially cylindrical body sized to accommodate said lift member and at least a portion of said rotatable support arm, a curved slot formed in the wall of said hollow cylindrical body, and a locking mechanism for securing a vertical position of said selector collar with respect to said lift member and said rotatable support arm.

5. The lift apparatus of claim 4, wherein said control system comprises at least one of:

a power switch for activating said lift mechanism, an outrigger position sensor switch, a locking mechanism position sensor switch, and a selector collar position sensor switch.

6. The lift apparatus of claim 5, wherein said locking mechanism comprises:

a spring-loaded pin disposed in said selector collar, and an indexing detent disposed on said rotatable head, wherein said indexing detent is sized to accommodate said spring-loaded pin.

7. The lift apparatus of claim 3, additionally comprising a hanger slidably supported on said support arm.

8. The lift apparatus of claim 3, wherein said base frame additionally comprises one or more wheels, and one or more wheel locking mechanisms for controlling movement of said one or more wheels.

9. The lift apparatus of claim 3, wherein said lift actuator comprises one or more of: an electric, pneumatic or hydraulic actuator.

10. The lift apparatus of claim 3, wherein said control system further comprises a controller for controlling said lift mechanism.

11. The lift apparatus of claim 3, wherein said locking mechanism comprises a spring loaded pedal and a notch disposed on said outrigger and sized to snugly accommodate said pedal.

12. The lift apparatus of claim 3, wherein said outrigger is spring loaded for maintaining said outrigger in a predetermined position.

13. The lift apparatus of claim 3, wherein said outrigger is extendible in length.

14. The lift apparatus of claim 7, further comprising a sling affixed to said hanger for supporting said load.

15. The lift apparatus of claim 3, said support arm further comprising a bracket affixed to said support arm.

16. The lift apparatus of claim 3, wherein said selected side of said lift apparatus comprises a first side or a second side of said lift apparatus, and said support arm selector controls a rotation of said support arm to either said first or second side of said lift apparatus.

17. The lift apparatus of claim 3, further comprising a power source for powering said lift actuator.

18. The lift apparatus of claim 3, further comprising a seat affixed to said lift apparatus.

19. The lift apparatus of claim 3, wherein said lift member is telescopically housed within a guide housing.

20. The lift apparatus of claim 3, wherein said outrigger is pivotably affixed to said base frame and is laterally pivotable to said selected side of said lift apparatus.

* * * * *